United States Patent [19]

Walsh

[11] Patent Number: 4,703,220

[45] Date of Patent: Oct. 27, 1987

[54] INCANDESCENT LAMP WITH EXTENDED FILAMENT LIFETIME

[75] Inventor: Peter J. Walsh, Stirling, N.J.

[73] Assignee: Duro-Test Corporation, North Bergen, N.J.

[21] Appl. No.: 381,921

[22] Filed: May 26, 1982

[51] Int. Cl.[4] ..... H01K 1/26; H01K 1/32

[52] U.S. Cl. ..... 313/112; 313/580; 313/315; 313/334

[58] Field of Search ..... 313/112, 113, 578, 580, 313/609, 610, 611, 315, 334, 17, 20

[56] References Cited

U.S. PATENT DOCUMENTS

| | | | |
|---|---|---|---|
| 4,280,076 | 7/1981 | Walsh | 313/580 X |
| 4,281,274 | 7/1981 | Bechard et al. | 313/578 X |
| 4,338,540 | 7/1982 | Sovilla | 313/112 X |

*Primary Examiner*—David K. Moore
*Assistant Examiner*—K. Wieder
*Attorney, Agent, or Firm*—Darby & Darby

[57] ABSTRACT

An incandescent lamp has an envelope within which is enclosed an incandescent filament. The incandescent filament is surrounded by a tubular element with open ends. The element transmits visible radiation, and reduces but does not eliminate convection around the filament. This reduces the rate at which evaporated filament material is carried away from the filament and deposited elsewhere within the lamp. If desired, a filter coating may be placed on the element for reflecting infrared radiation back to the filament and transmitting visible radiation away from the filament and out of the lamp. The element may engage the filament leads for mounting purposes.

20 Claims, 4 Drawing Figures

INCANDESCENT LAMP WITH EXTENDED FILAMENT LIFETIME

This invention pertains to incandescent lamps, and more particularly to incandescent lamps in which convection currents within the lamp carry material away from the filament.

In an incandescent lamp, an incandescent filament is enclosed within an envelope. When the lamp is in use, current flowing through the filament heats it to a high temperature, in the range of about 2400° C. to 2700° C. The envelope of the lamp is substantially cooler and may be at, e.g., 50° C. There is thus a substantial temperature gradient in the lamp's interior space since the filament is very hot while the envelope is comparatively cool. As a result of this temperature gradient, convection currents are generated, and they circulate within the envelope.

As the filament is heated, the filament material vaporizes and evaporates in atomic or molecular form. This has two disadvantageous results. First, the material is carried away by convection and tends to deposit on a cooler surface such as the envelope. This blackens or darkens the envelope, thereby changing its optical transmission characteristics. Second, the lifetime of the filament decreases because of erosion of material.

Convection also causes the lamp to be less efficient because the moving gas molecules transfer heat away from the filament. This is called gas heat loss. As a result of gas heat loss, more energy is required to heat the filament to its desired operating temperature, reducing lamp efficiency.

It is an object of the invention to provide an incandescent lamp having an extended filament lifetime.

It is another object to provide an incandescent lamp in which convection around the filament is reduced so that evaporated filament material is not carried away to the same extent as in prior art incandescent lamps.

It is still another object to reduce the gas heat loss of an incandescent lamp.

It is still further an object to provide with an extended filament lifetime an incandescent lamp of the type in which infrared radiation is reflected back to the filament and visible radiation is transmitted out of the lamp.

It is yet another object to provide a lamp with a transparent heat mirror coating which is applied to a surface other than the envelope.

It is yet another object to provide an incandescent lamp of any of the above-mentioned types which is easy and inexpensive to manufacture and assemble.

These objects, among others, are achieved in the present invention by a means which reduces convection around the filament. The means is an open-ended element, preferably a cylinder, which transmits visible radiation and which coaxially surrounds the filament. The internal radius of the cylinder is advantageously greater than the thickness of the Langmuir layer which surrounds the filament. The element need not be a cylinder and may be of any other suitable shape.

The element reduces convection so that less of the evaporated filament material is carried away from the filament. Hence, there is a greater opportunity for evaporated filament material to recombine with the filament. This reduces filament erosion and increases filament lifetime.

Furthermore, by reducing convection the amount of heat drawn away from the filament by convected gas is reduced. As a result, less energy is required to maintain the filament at its desired operating temperature.

By permitting some convection to remain, the evaporated filament material which is carried away does not deposit on the element, but rather deposits on the envelope. This prevents the blackening from being transferred to the element from the envelope.

If desired, a transparent heat mirror may be placed on the element. Such coatings are known by themselves. By placing such a heat mirror on the element, infrared radiation is reflected back to the filament, decreasing the amount of energy required to maintain the filament at its desired operating temperature and thus increasing lamp efficiency, while permitting visible light to pass out of the lamp.

BRIEF DESCRIPTION OF THE DRAWINGS

The drawings show preferred but nonetheless illustrative embodiments of the invention, in which.

DETAILED DESCRIPTION OF PREFERRED EMBODIMENTS

Figure 1:
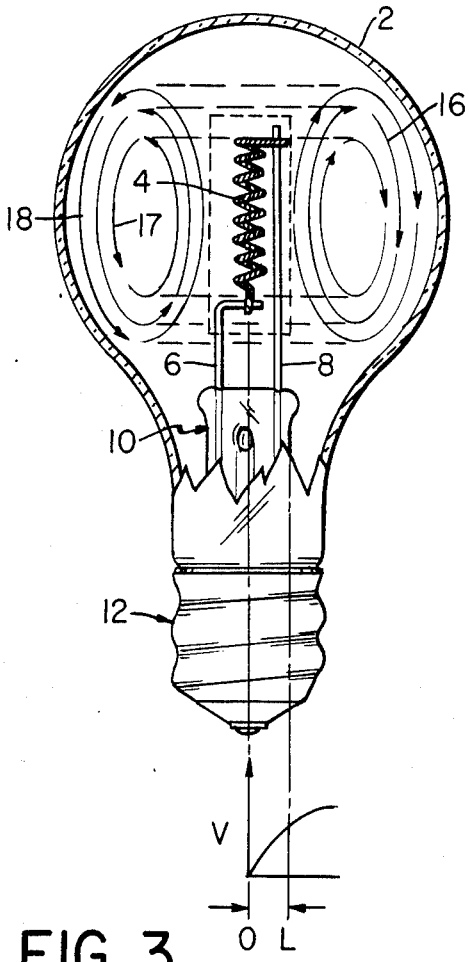
FIG. 1 is a schematic diagram and graph which illustrates convection phenomena within a conventional incandescent lamp.
Figure 2:
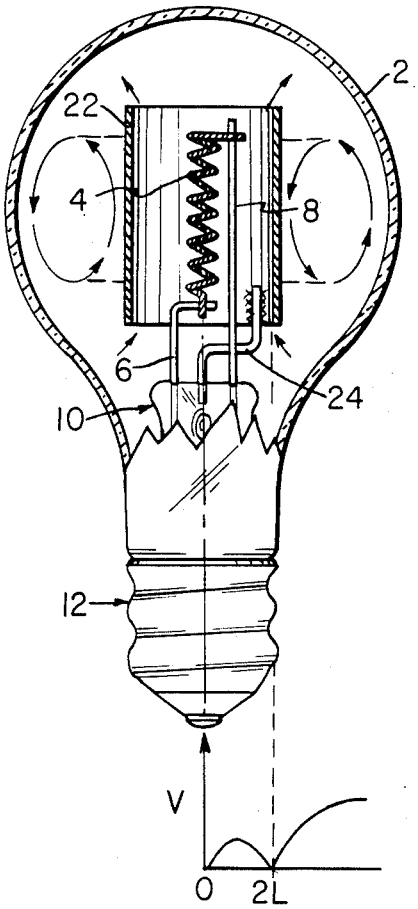
FIG. 2 is a schematic diagram and graph illustrating convection phenomena in a first embodiment of the invention.
Figure 3:
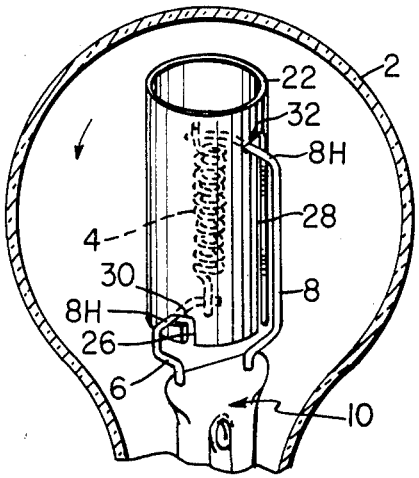
FIG. 3 is a schematic perspective view of a second embodiment of the invention.

In FIGS. 1–3, there is shown an envelope 2 of lime glass or other suitable conventional transparent vitreous material. A filament 4 is located within the envelope. The filament 4 is elongated, and in this example is made of tungsten or doped tungsten. The filament may be either single coil, coiled-coil or triple coil. Other filament shapes and materials may be used. The ends of filament 4 are is connected to leads 6 and 8, which are supported by a reentrant stem 10 and connected to the threaded ferrule and button contact of a conventional base 12 which permits connection to a conventional power source (not shown).

In a typical example, filament 4 heats to about 2400° C.–2700° C. when energized and incandesces, giving off energy in both the visible and infrared portions of the spectrum. Envelope 2 is heated by radiation from filament 4 and by convection, but since envelope 2 is spaced from filament 4 and is exposed to ambient, e.g. room temperature, envelope 2 remains at a much lower temperature of, e.g. 50° C. It will be understood that these operating temperatures may vary, and are given for explanatory purposes only.

Convection phenomena take place as a result of the temperature gradient between filament 4 and envelope 2. Convection currents follow paths which are schematically indicated by arrows in FIG. 1, where the paths form a series of concentric hollow toroids 14, 16, 18 which are centered on filament 4 and extend to the inner surface of envelope 2.

The graph below the lamp in FIG. 1 shows that convection velocity V at filament 2 is zero. As the distance from filament 2 increases, convection speed increases and then begins to level off. (The graph in FIG. 1 is illustrative and not to scale.) When filament 4 is energized, its high temperature causes filament material (here, tungsten atoms) to evaporate. Normally, such evaporated material is carried away from filament 4 by convection and deposited on the cooler inner surface of envelope 2. This evaporation and deposition causes blackening of the lamp, decreasing light output and lamp efficiency. Furthermore, filament 4 is eroded at one or more points or areas along its length. These eroded points or areas are stressed and often will beak upon the application of current, thereby causing lamp failure.

Evaporated filament material does not by itself disperse evenly throughout the interior of envelope 2. Such material generally remains within a constant distance from filament 4. This distance, called the Langmuir radius L, defines a layer around filament 4 which is shown by the dotted lines 20. This layer is called the Langmuir layer and in the example the layer 20 is generally cylindrical and coaxially surrounds filament 4. Typically, the Langmuir layer will be 9 mm in diameter for a krypton gas enclosure with a 1.6 mm filament and an operating temperature of 2900° C. Normally, without considering convection currents, evaporated filament material remains within the Langmuir layer 20.

However, since convection adjacent filament 4 and within Langmuir layer 20 is not zero, evaporated filament material is carried away from filament 4 by convection currents passing through the region where most evaporated filament material is located. In prior art lamps nothing interferes with the tendency of convection currents to carry away evaporated filament material.

FIG. 2 shows a preferred embodiment of the invention which reduces convection adjacent the filament and its effects described above. An elongated open-ended tubular element, here shown as a cylinder 22, surrounds and is coaxial with filament 4. Cylinder 22 is held in place by a support post 24 embedded in stem 10 and attached to cylinder 22. Cylinder 22 transmits visible radiation and has an internal diameter which is approximately twice the Langmuir radius L, but which may be between 10 and 20 mm in typical situations.

Cylinder 22 constrains convection currents within the lamp so that such currents have a zero velocity not only at filament 4 itself but also at the inner and outer surfaces of cylinder 22. Therefore, a convection velocity graph such as is shown in FIG. 2 arises. (This graph is illustrative and not to scale.) As shown, cylinder 22 decreases total convection within Langmuir layer 20, while permitting convection to increase elsewhere.

As a result, convection currents are reduced in that region within the Langmuir layer where they would normally tend to carry evaporated filament material away from filament 4. Therefore, as compared with a prior art conventional lamp with no shield, less filament material is carried away from filament 4. Thus, evaporated filament material tends to remain within cylinder 22, convection currents outside cylinder 22 notwithstanding.

Because the evaporated filament material is less migratory and remains adjacent filament 4 which is at a comparatively high temperature, recombination of the evaporated filament material with filament 4 is more likely. Thus, while cylinder 22 does not by itself tend to reduce evaporation from filament 4, it does tend to increase the likelihood of recombination and reduces the net loss of material from filament 4. This reduces filament erosion and extends filament life. Furthermore, since there is less filament material carried away from filament 4, blackening of the inner surface of envelope 2 is reduced. Reducing convection adjacent filament 4 also reduces gas heat loss, and lamp efficiency increases.

To further reduce convection within acceptable limits, the tubular element may not be cylindrical. It may be frustrum-shaped or flared so that its lower end is smaller than its upper end. This limits the intake of convection currents at the bottom of the tubular element, when the filament is vertically oriented. In the case of a horizontal filament, it is desirable to tilt the tubular element so that it is not horizontal. This prevents convection from being eliminated. Alternatively, a horizontal tubular element may be vented by longitudinal slits in its top and bottom. The slit at the bottom may be narrower than the slit at the top, to accomplish the intake limiting effect set forth above.

It should be understood that cylinder 22 does not eliminate convection; convection is merely reduced. Thus, the filament material which is carried away is deposited on the inner surface of envelope 2, and does not blacken cylinder 22.

If desired, a transparent heat mirror may be placed on the tubular element, either on the inner or the outer surface thereof, as by chemical or electric vapor deposition, sputtering, or other suitable technique. Such a mirror is known by itself and one suitable type is described in U.S. Pat. No. 4,160,929. It may be a multilayer filter coating in which a layer of insulator material is sandwiched between two layers of metal, or may alternatively be a coating in which a layer of metal is sandwiched between two layers of dielectric material. Alternatively, an all-dielectric or semiconductor multilayer filter coating may be used.

If such a heat mirror is placed on the tubular element, a large part of the infrared radiation generated by filament 4 will be reflected back. This will raise the temperature of filament 4 and less energy is thus required to maintain filament 4 at its desired operating temperature. Such filter coatings do not substantially impede the transmission of visible light.

Figure 4:
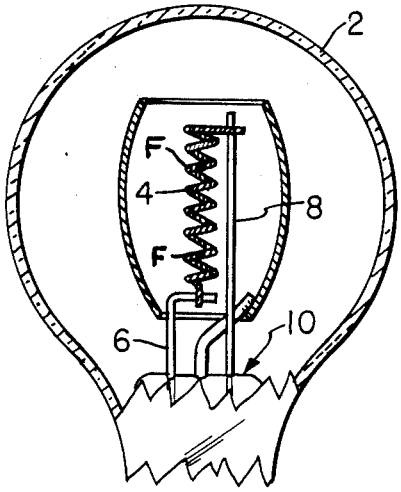
FIG. 4 is a view of an embodiment of the invention which uses a heat mirror.

When a transparent heat mirror is used, it can prove advantageous to make the tubular element elliptical, rather than cylindrical. By so doing, infrared radiation will be reflected back to a focus of the ellipse, and not out of an open end of the tubular element, as would be the case if the tubular element were a cylinder. To accomplish the limiting effect set forth above, the top end of the tubular element may be larger than the bottom end—see FIG. 4. Advantageously, the filament will pass through both foci F of the ellipse.

Cylinder 22 may be mounted on leads 6 and 8 which support filament 4 rather than being mounted to stem 10. In FIG. 3, leads 6 and 8 support filament 4 vertically and are mounted to a reentrant stem 10 above the base (not shown) of the Cylinder 22 may be mounted on leads 6 and 8 which support filament 4 rather than being mounted to stem 10. In FIG. 3, leads 6 and 8 support filament 4 vertically and are mounted to a reentrant stem 10 above the base (not shown) of the lamp. In this example, lead 6 has a horizontal section 6H and lead 8 has a corresponding horizontal section 8H. Sections 6H and 8H lie in parallel planes, and are connected to opposite ends of filament 4.

Cylinder 22 has two parallel and opposed longitudinally extending slots 26 and 28 which extend upwardly from its bottom edge. Slot 26 is shorter and engages section 6H of lead 6. Slot 28 is longer and engages section 8H of lead 8. The top end of slot 26 is connected to a circumferentially extending slot 30, while the top of slot 24 is connected to a circumferentially extending slot 32. Slots 30 and 32 are oppositely directed and are equally long. They may, e.g., subtend arcs of 45° as viewed from filament 4 or any other suitable angle.

When cylinder 22 is to be installed around filament 4 prior to completion of the lamp, the cylinder 22 is placed over leads 6 and 8 so that slot 28 engages section 8H of lead 8. Cylinder 22 is then moved down until slot 26 engages section 6H of lead 6. After moving cylinder 22 down once again, leads 6 and 8 reach the tops of slots 26 and 28 respectively. Cylinder 22 can then be rotated in the direction shown in FIG. 3, so that leads 6 and 8 are engaged in slots 30 and 32. This locks cylinder 22 to leads 6 and 8 and prevents cylinder 22 from coming loose. After installation of cylinder 22, the rest of the lamp can be manufactured by any suitable technique.

It will be appreciated that the tubular element need neither be cylindrical nor of any other named shape, as long as it has ends which are open enough to reduce but not eliminate convection around filament 4.

What is claimed is:

1. An incandescent lamp comprising:

an outer envelope;

an elongated incandescent filament within the outer envelope; and an elongated visible light transmissive second envelope separate and spaced from said outer envelope surrounding at least a substantial part of the length of said filament and having an internal surface spaced therefrom along its length by a distance greater than the thickness of the Langmuir layer of said filament when it is energized to incandesce and having an opening at each of its uppermost and lowermost vertical extremities to permit convection flow through said second envelope for reducing convection around the filament to a predetermined non-zero value at a location intermediate the filament and the inner surface of said second envelope and to substantially zero at said inner surface.

2. The lamp of claim 1, wherein said filament is mounted generally vertically and said second envelope is an open-ended cylinder and has an internal radius which is greater than a thickness of a Langmuir layer which surrounds the filament when it is energized to incandesce.

3. The lamp of claim 2, wherein the radius of said second envelope is approximately twice said thickness of said Langmuir layer.

4. The lamp of claim 2, wherein the cylinder is supported on leads which are connected to the filament.

5. The lamp of claim 4, wherein the cylinder is slotted to receive said leads.

6. The lamp of claim 1, wherein the second envelope has two openings and the lower opening is larger than the upper one.

7. An incandescent lamp comprising:

an outer envelope;

an incandescent filament within the envelope; and a second envelope spaced from said outer envelope and separate therefrom adjacent to and surrounding a substantial portion of the filament and spaced therefrom along its length by a distance greater than the thickness of the Langmuir layer of said filament when it is energized to incandesce and having an opening at each of its uppermost and lowermost vertical extremities to permit convection flow through said second envelope for reducing convection around the filament to a predetermined non-zero value at a location intermediate the filament and the inner surface of said second envelope and to substantially zero at said inner surface, reflecting infrared radiation emitted by the filament back to the filament, and transmitting visible radiation emitted by the filament.

8. The lamp of claim 7, wherein the filament is elongated and said second envelope comprises:

an elongated visible radiation transmissive member which surrounds the filament; and a visible radiation transmitting and infrared radiation reflecting filter coating on said member.

9. The lamp of claim 8, wherein said second envelope member is an open-ended cylinder and has an internal radius which is greater than a thickness of Langmuir layer which surrounds the filament when it is energized.

10. The lamp of claim 9, wherein the radius is approximately twice said thickness.

11. The lamp of claim 9, wherein the cylinder is supported on leads which are connected to the filament.

12. The lamp of claim 11, wherein the cylinder is slotted to receive said leads.

13. The lamp of claim 8, wherein the filter coating comprises a multilayer coating.

14. The lamp of claim 8, wherein the second envelope member has two open ends and one of said open ends is larger than the other one.

15. The lamp of claim 8, wherein the second envelope member is elliptical and has two open ends.

16. The lamp of claim 15, wherein the filament passes through the foci of the elliptical second envelope member.

17. The lamp of claim 15, wherein one of said open ends is larger than the other one.

18. The lamp of claim 1 or 7, wherein the filament contains tungsten.

19. The lamp of claim 1 wherein said filament is mounted generally vertically and the distance from the internal surface of the second envelope to the filament is approximately twice the thickness of said Langmuir layer.

20. The lamp of claim 8 wherein said filament is mounted generally vertically and the distance from the internal surface of the second envelope to the filament is approximately twice the thickness of said Langmuir layer.

* * * * *